US010926159B1

(12) United States Patent
Smith

(10) Patent No.: US 10,926,159 B1
(45) Date of Patent: Feb. 23, 2021

(54) LEAN-TO-STEER DEVICE WITH MOTORIZED STEERING RESPONSES

(71) Applicant: Corey C. Smith, Campton, NH (US)

(72) Inventor: Corey C. Smith, Campton, NH (US)

(73) Assignee: Lean Steer Difference, LLC, Campton, NH (US)

( * ) Notice: Subject to any disclaimer, the term of this patent is extended or adjusted under 35 U.S.C. 154(b) by 330 days.

(21) Appl. No.: 16/043,391

(22) Filed: Jul. 24, 2018

Related U.S. Application Data

(60) Provisional application No. 62/536,494, filed on Jul. 25, 2017.

(51) Int. Cl.
*A63C 17/01* (2006.01)

(52) U.S. Cl.
CPC ..... *A63C 17/011* (2013.01); *A63C 2203/18* (2013.01)

(58) Field of Classification Search
CPC ..... A63C 17/011–013
See application file for complete search history.

(56) References Cited

U.S. PATENT DOCUMENTS

| | | | | |
|---|---|---|---|---|
| 4,072,325 | A | 2/1978 | Bright et al. | |
| 7,293,622 | B1 | 11/2007 | Spital | |
| 8,240,686 | B2 | 8/2012 | Choi | |
| 8,322,477 | B2 | 12/2012 | Kamen et al. | |
| 9,216,763 | B2 | 12/2015 | Huntzinger | |
| 9,393,483 | B2 | 7/2016 | Tan et al. | |
| 9,526,977 | B2 | 12/2016 | Edney | |
| 9,616,318 | B2 | 4/2017 | Rogers | |
| 9,682,732 | B2 | 6/2017 | Strack | |
| 9,688,340 | B1 * | 6/2017 | Kroymann | B62K 23/06 |
| 9,821,620 | B2 | 11/2017 | Saeger et al. | |
| 10,160,503 | B1 * | 12/2018 | Zheng | A63C 17/017 |
| 10,384,116 | B1 * | 8/2019 | Yeh | A63C 17/0093 |
| 2005/0280232 | A1 * | 12/2005 | Cole | A63C 17/12 280/87.042 |
| 2005/0280233 | A1 * | 12/2005 | Cole | A63C 17/01 280/87.042 |
| 2006/0063137 | A1 | 3/2006 | Robbins | |
| 2006/0125200 | A1 * | 6/2006 | Cole | A63C 17/0046 280/87.042 |
| 2006/0231313 | A1 * | 10/2006 | Ishii | B62K 11/007 180/218 |
| 2007/0001415 | A1 * | 1/2007 | Cole | A63C 17/12 280/87.042 |
| 2013/0175777 | A1 * | 7/2013 | Bermal | A63C 17/0093 280/87.042 |
| 2014/0027192 | A1 * | 1/2014 | King | A63C 17/0006 180/181 |
| 2016/0158635 | A1 * | 6/2016 | Aders | A63C 17/015 180/65.1 |

(Continued)

*Primary Examiner* — Erez Gurari
(74) *Attorney, Agent, or Firm* — Jeffrey E. Semprebon; Semprebon Patent Services

(57) ABSTRACT

Continuous or discontinuous steering responses for a lean-to-steer device can be provided by controlling the steering angle of at least one wheel by a steering motor that is operated by a controller. The controller receives signals from a tilt sensor to calculate an appropriate steering angle for the at least one wheel. When a speed sensor is also provided, the controller can calculate a steering angle to match the curve radius of motion to the pendulum angle corresponding to the indicated speed and tilt.

11 Claims, 4 Drawing Sheets

(56) References Cited

U.S. PATENT DOCUMENTS

| | | | | |
|---|---|---|---|---|
| 2016/0206949 | A1* | 7/2016 | Murphy | A63C 17/12 |
| 2017/0144023 | A1* | 5/2017 | Moyerman | G06K 9/00 |
| 2017/0252637 | A1 | 9/2017 | Smith | |
| 2017/0297454 | A1* | 10/2017 | Pang | A63C 17/02 |
| 2018/0072367 | A1* | 3/2018 | Li | B62K 11/007 |
| 2018/0185738 | A1* | 7/2018 | Strand | A63C 17/006 |
| 2018/0214766 | A1* | 8/2018 | Ying | A63C 17/011 |
| 2018/0272891 | A1* | 9/2018 | Cerboneschi | B60Q 1/2607 |
| 2020/0216128 | A1* | 7/2020 | Doerksen | B60G 13/003 |
| 2020/0238159 | A1* | 7/2020 | Choi | B62K 11/00 |
| 2020/0254327 | A1* | 8/2020 | Doerksen | A63C 17/12 |

* cited by examiner

LEAN-TO-STEER DEVICE WITH MOTORIZED STEERING RESPONSES

BACKGROUND

Applicant has developed lean-to-steer devices that employ mechanical structures to provide "linear" or "non-linear" steering responses, as described in PCT/US2016/042877 and U.S. Publication 2017/0252637, both incorporated herein by reference. In a "linear" or continuous response, the steering angle of the wheel or wheels is increased in a continuously progressive manner responsive to tilting of a body of the device on which the operator is supported; as the tilt away from a neutral central orientation increases, the steering angle of the wheel(s) is continually increased; while described as 'linear", the steering response is typically not directly proportional to the degree of tilting. In a typical "non-linear" or discontinuous steering response, the steering of the wheels about a vertical steering axis increases progressively with increased tilting of the body about a longitudinal axis up to a certain point, after which further tilting is accommodated without change in the steering response, providing a constant curve radius set at a desired value. This action may be desired to simulate the action of downhill skis, which are often designed to carve a turn of a specific radius. In these prior art devices, adjustment of the set curve radius and/or adjustment of the proportionality of the steering action to provide a different response can be made by adjusting elements of the mechanism and/or by interchanging parts of the mechanism.

SUMMARY

Applicant has found that a steering response of a device can be controlled by a motor independently of the leaning action of the device, allowing the steering response to be easily adjusted, and in some cases to be adjusted automatically, such as to match the desired steering action to the current speed of the device. The independent steering response can be set to provide a continuous or discontinuous response to leaning, and can be either dependent or independent of speed, giving lean-to-steer devices that incorporate such motor-controlled steering response much greater flexibility than is currently available in devices that employ mechanical means to provide a steering response to leaning. In one example of a continually-adjustable response, the steering angle of the wheel(s) is adjusted to correspond to the radius of curvature at the current speed which matches the natural degree of tilt at that speed. At a given speed and radius of curvature of movement across a horizontal surface, there is an associated angle equal to the angle at which a pendulum will make relative to the surface due to the apparent centrifugal force acting on the pendulum, causing it to hang radially outwards from a straight vertical line. Thus, at a particular speed, any degree of tilt is matched to a certain radius of turn, and the steering angle of the wheel(s) can be adjusted to provide the matched radius of curvature, such that the current angle of tilt equals the"pendulum angle" for the current speed and radius of turn. With additional instrumentation, such as a gyroscope or other device to provide an indication of how the current surface deviates from a level horizontal surface, the angle or steering in response to tilting could be adjusted to accommodate travel across inclined surfaces, where a component of the tilt is due to the operator leaning the body of the device relative to the surface to compensate for the incline.

DETAILED DESCRIPTION

Figure 1:
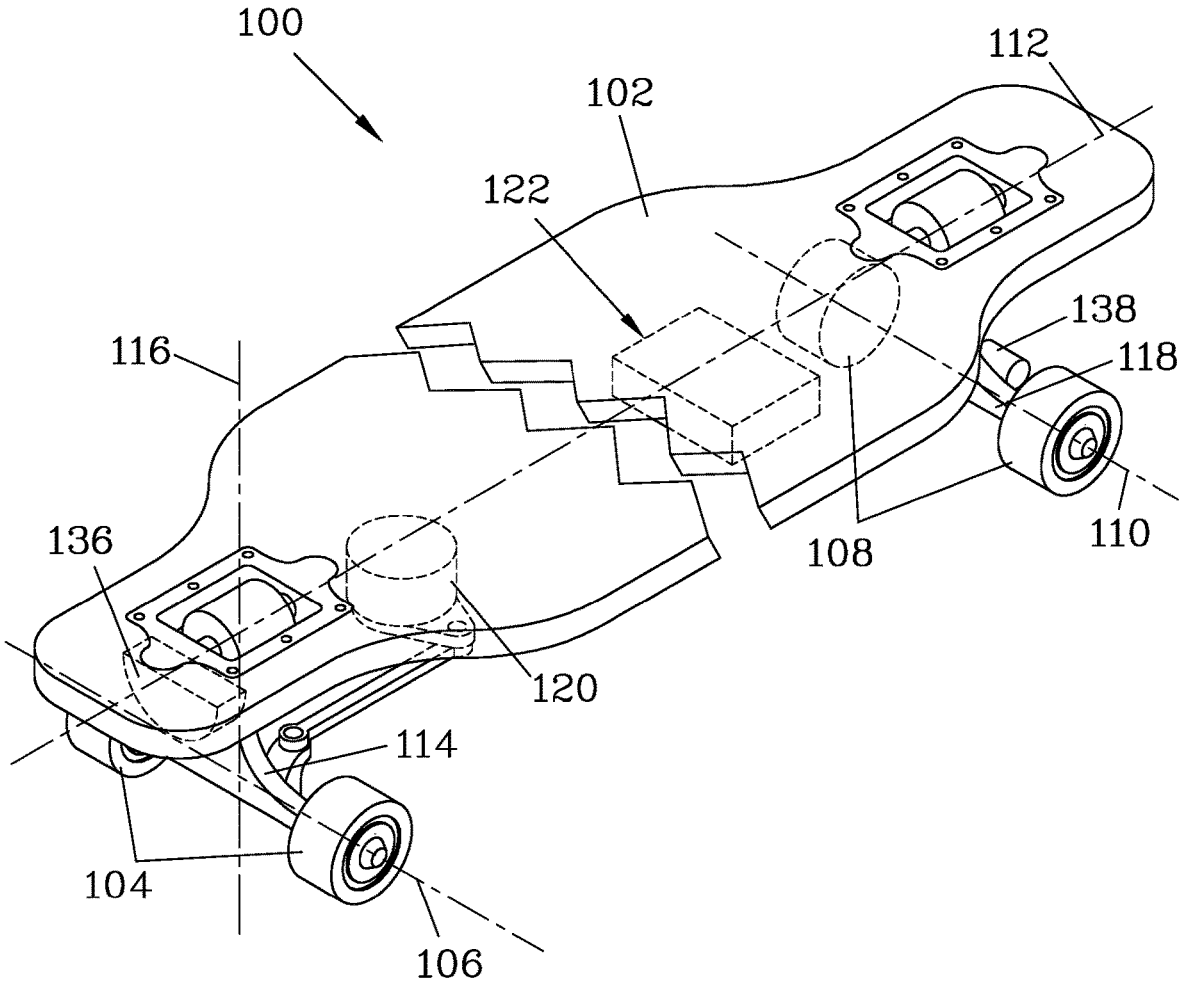
FIG. 1 is an isometric view showing a device that incorporates a motorized lean-to-steer mechanism that adjusts the steering angle of a pair of wheels about a vertical steering axis responsive to measured tilting of a body of the device on which an operator stands.
Figure 2:
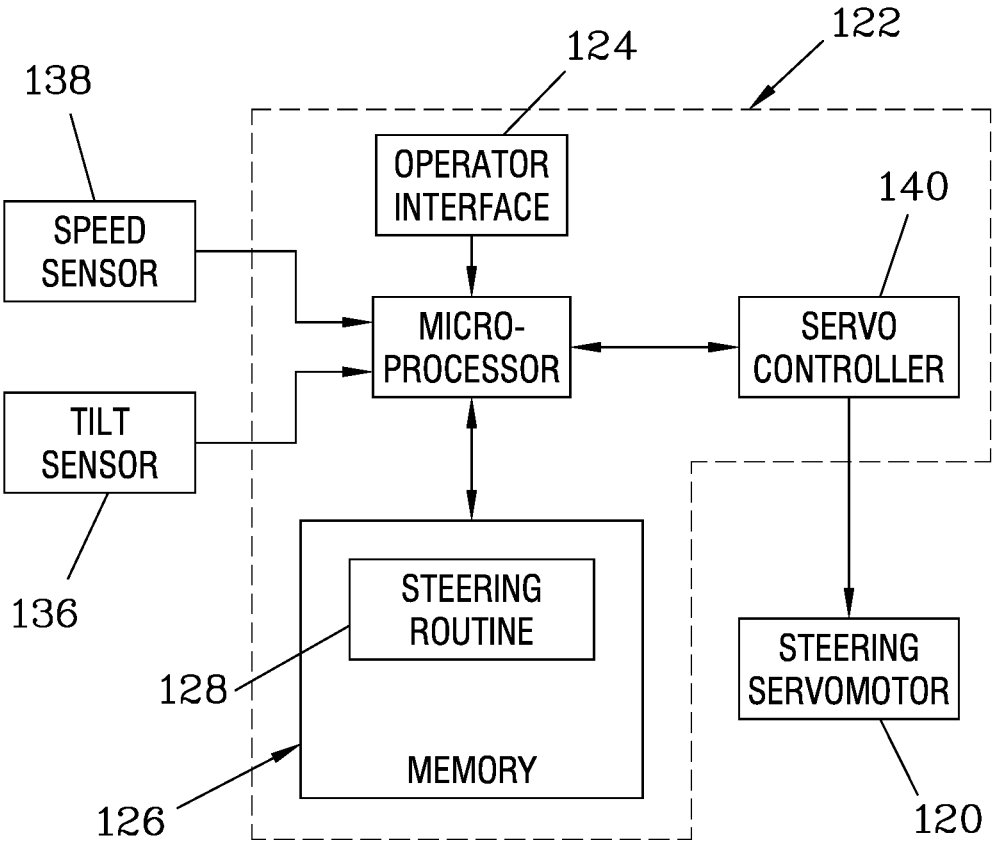
FIG. 2 is a block diagram showing the steering control system used in the device shown in FIG. 1.

FIGS. 1 and 2 illustrate a lean-to-steer device 100, FIG. 1 being a simplified isometric view of the device 100 and FIG. 2 being a block diagram illustrating elements of the control system for operating the steering of the device 100; conventional elements of an electrically-operated device, such as batteries for power, wiring, etc. are well known to those skilled in the art and are therefore not illustrated. As with mechanical lean-to-steer devices, the motorized lean-to-steer device 100 has a body 102 for supporting a user, a first wheel or pair of wheels 104 rotatable about a first wheel axis 106, and a second wheel or pair of wheels 108 mounted with respect to the body 102 so as to rotate about a second wheel axis 110 that is displaced from the first wheel axis 106 along a longitudinal axis 112 of the device 100. In the device 100 illustrated and described, paired wheels (104, 108) are employed; however, a device could employ a single wheel if the rim of the wheel is designed to maintain the wheel axis horizontal.

The first wheels 104 are mounted to the body 102 via a first wheel mounting structure 114 that allows the body 102 to tilt relative to the first wheels 104 about the longitudinal axis 112 while the first wheel axis 106 remains horizontal. The first wheel mounting structure 114 is also configured to allow the first wheels 104 to pivot about a first vertical steering axis 116 in order to change the inclination of the first wheel axis 106 relative to a vertical plane (not shown) that contains the longitudinal axis 112. The first wheel mounting structure could be provided by modifying a mechanical lean-to-steer structure such as taught in Applicant's U.S. Publication 2017/0252637, incorporated herein by reference, by leaving out those interlocking elements that constrain the motion in order to provide the mechanical steering response.

The second wheels are mounted to the body by a second wheel mounting structure 118 configured to allow the body 102 to tilt about the longitudinal axis 112 while the second wheel axis 110 remains horizontal. Alternatively, a single second wheel having a rounded profile could be employed, allowing the second wheel axis 110 to tilt with tilting of the body 102. While the second wheel mounting structure 118 shown does not provide any steering action in response to tilting of the body 102, the second wheel mounting structure could provide such action in a manner similar to that of the first wheel mounting structure 114, discussed below.

The steering position of the first wheel axis 106 is set by a steering motor 120 that is connected to the first wheel mounting structure 114 and can change the position of the first wheels 104 about the steering axis 116 by operating gears, linkages, direct servo drive, or other steering mechanisms as known in the art. While illustrated as connecting to the first wheel mounting structure 114 via a linkage, the steering motor 120 could be incorporated into the first wheel mounting structure 114, and such incorporation may make it easier to retrofit the present steering response scheme into pre-existing lean-to-steer devices. The steering motor 120 could be positioned on the steering axis 116 and directly coupled to a steering shaft (not shown) to adjust the steering angle of the first wheels 104 about the steering axis 116.

Figure 3:
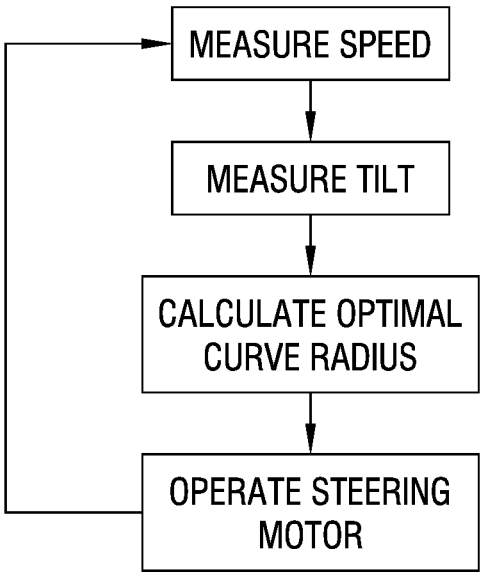
FIG. 3 is a flow chart illustrating one example of a steering routine that can be employed by the steering control system shown in FIG. 2 to control the steering angle in a continuous manner to match the measured speed and tilt of the device.

The operation of the steering motor 120 is controlled by a controller 122, which typically includes a microcomputer. The controller 122 can be provided with an operator interface 124 that allows an operator to select the desired parameters of the steering response. One simple scheme for providing the operator interface 124 is to provide a wireless connection that communicates with a remote device, such as a tablet or smart telephone that communicates with the operator interface 124 through wireless communication and runs a software application allowing the operator to select the desired response parameters. The controller 122 may have an associated memory 126 that stores parameters set by the user via the operator interface 124, such as selected routines to provide multiple desired steering responses of the device 100. FIGS. 2 and 3 illustrate one example of a continuous steering response, while FIGS. 4 and 5 discussed below illustrate one example of a discontinuous steering response, the controller 122 could allow an operator to select either of these steering responses, or to select additional response schemes that could be stored in the memory 126. For the continuous response, the memory 126 contains a steering routine 128 that is configured to provide a harmonious match of steering to the current speed of the device 100 and current "pendulum angle" of the body 102 on which the operator is supported.

Additional routines that adjust the steering response conditionally could be included in the memory 126, and could be either selectively activated by the operator or set as default routines, such as routines to alter the steering response to provide safer operation of the device 100. For example, where instrumentation is provided to detect steering oscillations at a frequency indicative of high-speed wobble, a routine could be provided to detect such a condition and reduce the steering response to correct the condition. In another example, a routine could be set to provide a delayed change in steering response relative to indicated speed, to compensate for conditions where the operator may manipulate the device such that the wheel rotation speed does not accurately reflect the actual speed of the device over the ground surface. One example of the such condition may exist when a user turns the device sideways to slow, causing the wheels to slip across the surface momentarily before the operator straightens out the device; a delayed-response routine would avoid having the steering response dramatically change during the interval when the operator turns sideways, causing the wheels to slow or stop briefly before straightening out causes them to rotate again.

A tilt sensor 136 is attached to the body 102 and provides a tilt signal that indicates the current tilt of the body 102 about the longitudinal axis 112 from a neutral central position where the body 102 is horizontal. Typically, the tilt sensor 136 responds to the relative tilt between the body 102 and the first wheel axis 106, which is nominally horizontal. Various sensors capable of measuring the angle between two components could be employed, and the tilt sensor 136 may be configured to measure the relative angle between the body 102 and the portion of the first wheel mounting structure 114 to which the first wheels 104 are rotatably mounted. In the embodiment illustrated, a speed sensor 138 is also provided, which provides a speed signal that indicates the current speed of the device 100 over the ground, such as by monitoring the rotation speed of one or more of the wheels (104, 108). These signals are provided to the controller 122. The tilt sensor 136 and/or the speed sensor 138 could be incorporated into a unit with the steering motor 120 and/or the first wheel mounting structure 114, particularly when it is desired to retrofit the present invention into a pre-existing lean-to-steer device by replacing an existing wheel mounting structure with the first wheel mounting structure 114. In such retrofitting situations, the additional components necessary to provide the invention can be incorporated into a unit that provides the first wheel mounting structure 114, and/or can be mounted to an underside of the body 102. When the first wheel mounting structure 114 includes a spherical element to allow tilting and steering motion of the first wheels 104 relative to the body 102, the tilt sensor 136 could be provided by a sensor that monitors the relative position of the spherical element in a manner similar to that employed in trackballs employed to provide computer "mouse" input. In such cases, either the tilt sensor 136 or a separate sensor could also provide an indication of the current steering angle of the first wheel axis 106 about the steering axis 116, which could be used to allow the controller 122 to detect conditions such as high-speed wobble and adjust the steering response accordingly.

The controller 122 operates the steering motor 120 via a motor controller 140 to adjust the angle of the first wheels 104 responsive to the tilt signal in order to provide the desired steering response. For the steering routine 128, the speed signal and tilt signal in combination are used to calculate the appropriate radius of curvature at that speed for which the current degree of tilt is the "pendulum angle". The controller 122 then operates the steering motor 120 to increase or decrease the angle of the first wheels 104 about the steering axis 116 to direct the device 100 to steer into a curve of the calculated radius. While not shown in the device 100, a similar steering action could be provided for the second wheels 108 with an additional steering motor, or by providing a linkage to operate the second wheels 108 in coordination with the first wheels 104

The basic control scheme discussed above is illustrated in the flow chart shown in FIG. 3. The speed is measured using the signal from the speed sensor 138 and the current degree of tilt is measured using the tilt sensor 136. The current speed and tilt measurements are used to calculate an appropriate radius of turn curvature to match the current degree of tilt to the "pendulum angle" for the speed and curve radius. The controller 122 then operates the steering motor 120 to set an appropriate position of the first wheels 104 about the steering axis 116 for the calculated turn radius. The procedure repeats, continually measuring the speed and tilt, calculating the matching curve radius, and adjusting the steering accordingly.

It should be appreciated that the above description only sets forth one example of a possible control scheme of the present invention, and alternative control schemes could be employed to provide a desired steering response for the intended use of the device. For example, if additional instrumentation such as a gyroscope (not shown) is employed to provide the controller 122 with information on the relative inclination of the ground surface, the response to the indication from the tilt sensor 136 can be adjusted to accommodate a component of the tilt caused by the operator adjusting the lean of the body 102 to remain upright on the inclined surface. In the case where the operator is traveling straight across an inclined surface (remaining at the same level, traveling normal to the direction of the slope), there is a component of tilt caused by the operator remaining upright, roughly equal to the inclination of the surface from a horizontal plane. If the steering motor 120 were operated to respond to this indicated tilt, it would cause the device 100 to steer into a curve rather than travel straight across the inclined surface. Thus, separating the component due to the incline of the underlying surface allows the controller 122 to operate the steering motor 120 only in response to tilt relative to this inclined neutral position of the body 102. The instrumentation should be designed to monitor fore-and-aft tilting as well as side-to-side tilting, to accommodate for the case where the operator is traveling at an angle relative to the incline (i.e., traveling with a component of motion horizontally-directed across the incline and a component of motion straight either downhill or uphill).

Figure 4:
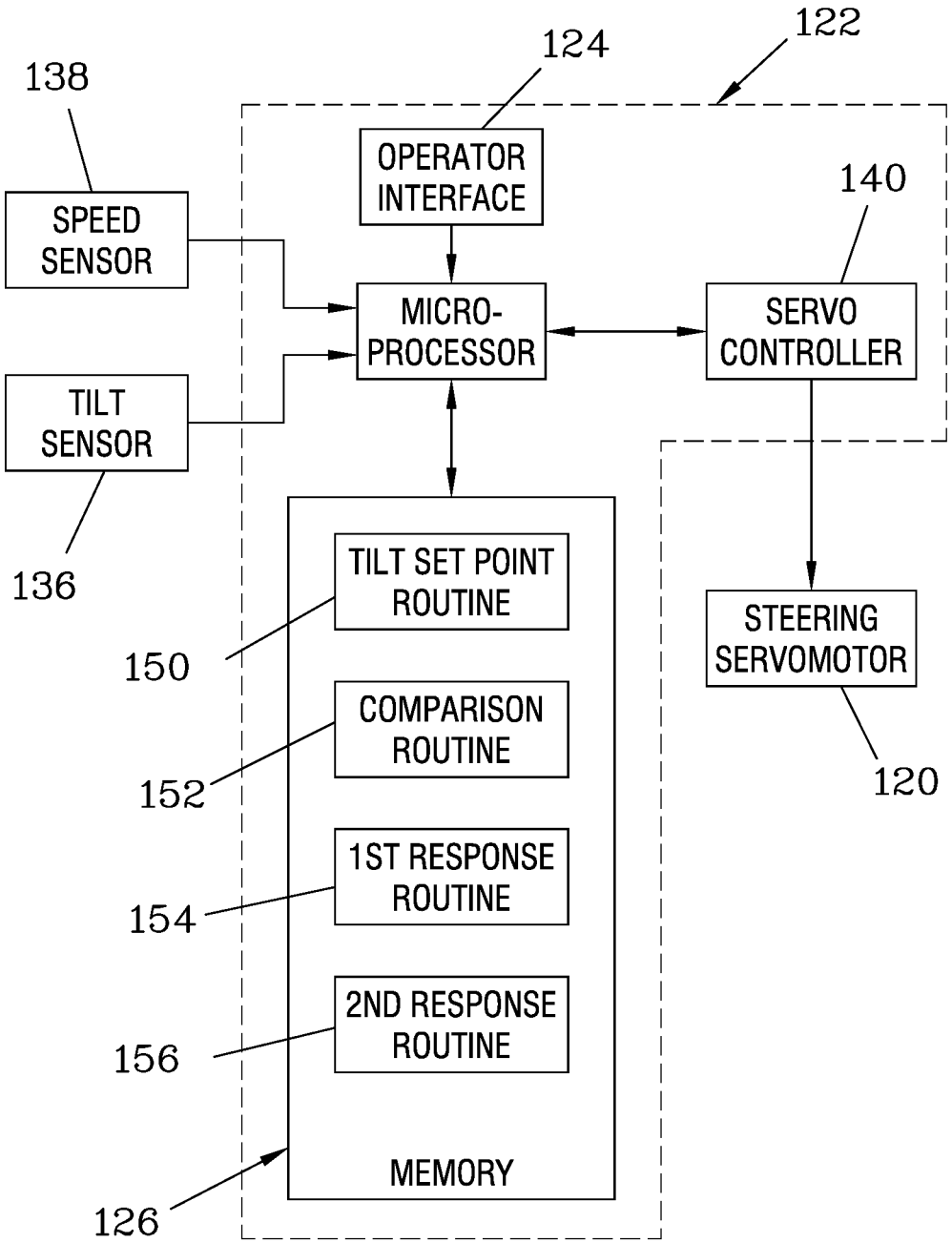
FIG. 4 is a block diagram of the steering control system used in the device shown in FIG. 1, when a discontinuous steering routine is employed.
Figure 5:
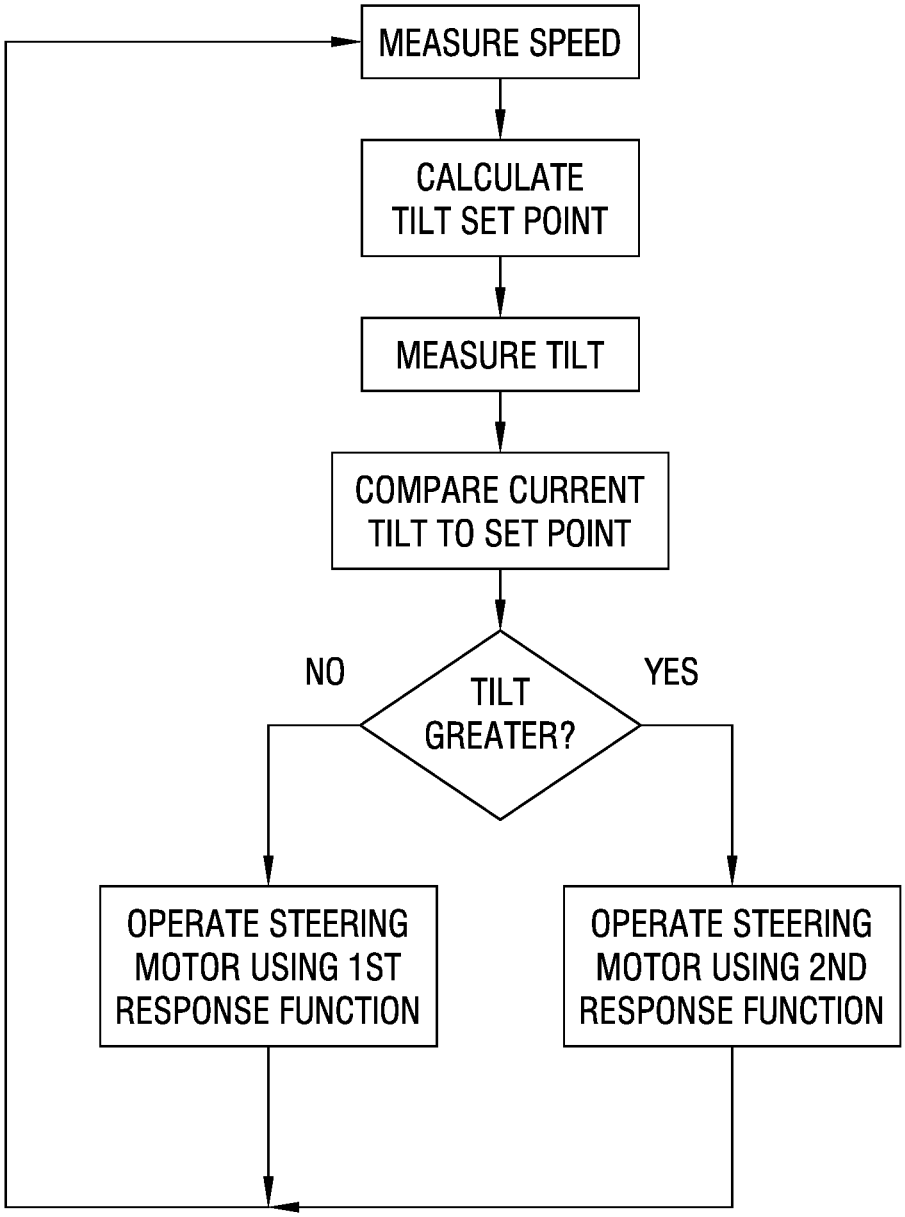
FIG. 5 is a flow chart illustrating one example of a steering routine that provides a discontinuous response, which provides a different steering response depending on whether the measured tilt falls within a first range or a second range.

The controller 122 can also be programmed to provide a discontinuous ("non-linear") steering response, such as to better simulate the action of snow skis that are designed to carve turns at a particular design radius. One example of a discontinuous response is illustrated in FIGS. 4 and 5, which provide a steering response that could be adjusted to simulate the action of a downhill ski. In this scheme, the steering response is continual up to a specified degree of tilt, and the response to further tilting is different. In the illustrated scheme, the set point degree of tilt at which the response changes is determined based on the speed; alternatively, the set point could be independent of speed, and remain at a value stored in the memory 126 after being set by the operator using the operator interface 124. The speed signal is provided to a tilt set point routine 150 stored in the memory 126, which calculates an appropriate set point for that speed to provide the desired discontinuous steering action. A comparison routine 152 then compares the current angle of tilt, as indicated by the tilt signal, to the set point to determine whether the currently-indicated angle of tilt is greater than the set point value. If not, then the controller 122 operates the steering motor 120 using the first steering response routine 154, which in a typical example increases the angle of the first wheels 104 about the steering axis 116 in a continuously progressive manner in response to the amount of tilt of the body 102 from its neutral position. If the comparison routine 152 finds that the currently-indicated tilt is greater than the set point for the currently-indicated speed, then the controller 122 operates the steering motor 120 using the second steering response routine 156, which may simply maintain the steering position of the first wheels 104 constant even if the operator tilts the body 102 beyond the calculated set point degree of tilt.

The discontinuous-response control scheme discussed above with respect to FIG. 4 is illustrated in the flow chart shown in FIG. 5. The speed is measured (using the signal from the speed sensor 138) and used to calculate an appropriate tilt set point (using the tilt set point routine 150). The current tilt of the body 102 is then measured (using the signal from the tilt sensor 136) and compared to the calculated set point (by the comparison routine 152). If the current tilt is not greater than the set point, the controller 122 operates the steering motor 120 using the first steering response routine 154 to set an appropriate position of the first wheels 104 about the steering axis 116 for the current degree of tilt indicated. The procedure repeats, continually measuring the speed, calculating the set point, measuring the current tilt, comparing the current tilt to the set point, and adjusting the steering accordingly. If the comparison routine 152 finds that the currently-indicated tilt is greater than the calculated set point, then the controller 122 switches to operating the steering motor 120 using the second steering response routine 156, and again repeats the procedure of monitoring speed and tilt and comparing the tilt to the calculated set point for the current speed.

As noted above, in a simpler scheme the steering response could be adjusted relative to a predetermined set point of tilt that is independent of speed, in which case the speed sensor 138 would not be needed. This may be desirable to provide a steering response that simulates the action of a downhill ski. Even when a speed sensor is not provided, the present invention provides a benefit over lean-to-steer devices that employ mechanical steering control to provide a discontinuous response, as the steering response can be readily changed by the operator via the operator interface. For the device 100, the controller 122 could be programmed to allow the operator to choose between various control schemes, such as continuous responses (as discussed with regard to FIGS. 2 and 3) and discontinuous responses (either speed-dependent or speed-independent), in order to provide different steering actions without requiring mechanical adjustment or replacement of components.

The present invention provides benefits for either motor-driven or non-driven lean-to-steer devices. Since power must be provided to operate the steering motor and to power the electronics of the controller and associated equipment, the present invention should be particularly advantageous for use to control the steering action of motorized lean-to-steer devices, in which case the device has a driven wheel. In such situations, some of the elements for sensing and controlling may be integrated with the equipment employed to control the drive speed of the device. Alternatively, in some cases it may be practical to employ the energy of the rotating wheels to generate electrical power to operate the steering control system of the device.

While the novel features of the present invention have been described in terms of particular embodiments and preferred applications, it should be appreciated by one skilled in the art that substitution of materials and modification of details can be made without departing from the spirit of the invention.

The invention claimed is:

1. A motorized lean-to-steer device comprising:

a body for supporting a user;

a first wheel rotatable about a first wheel axis;

a first wheel mounting structure that attaches said first wheel to said body while allowing said body to tilt relative to said first wheel about a longitudinal axis while said first wheel axis remains horizontal, said first wheel mounting structure being configured to allow said first wheel to pivot about a vertical steering axis to alter the inclination of the first wheel axis relative to a vertical plane containing the longitudinal axis;

a second wheel mounted with respect to said body so as to rotate about a second wheel axis that is displaced from said first wheel axis along the longitudinal axis; said second wheel being configured and mounted so as to allow said body to tilt about the longitudinal axis;

a tilt sensor for monitoring the degree of tilt of said body relative to said first wheel about the longitudinal axis;

a steering motor for adjusting the angular position of said first wheel about the steering axis; and a controller that receives a tilt signal from said tilt sensor and controls said steering motor to adjust the angular position of said first wheel about the steering axis in response to the tilt signal, said controller acting to provide a first response function adjusting the angular position of said first wheel responsive to the tilt signal when the degree of tilt indicated by the tilt signal is within a first tilt range, and said controller acting to provide a second response function adjusting the angular position of said first wheel responsive to the tilt signal when the degree of tilt indicated by the tilt signal is within a second tilt range, wherein said second response function is different from said first response function.

2. The lean-to-steer device of claim 1 further comprising:

a drive motor operably coupled to drive one of said first wheel and said second wheel.

3. The lean-to-steer device of claim 1 further comprising:

an operator interface that allows an operator to select the parameters of the first tilt range and the second tilt range.

4. The lean-to-steer device of claim 1 wherein said first response function provides a proportional increase in angle of said first wheel from a center position in response to increasing increase in angle of tilt of said body from a central position.

5. The lean-to-steer device of claim 1 further comprising:

a speed sensor that provides a signal indicating the current speed of the device across the underlying surface; and a tilt set point routine for said controller, said tilt set point routine operating to establish the first tilt range and the second tilt range, responsive to the speed signal.

6. A motorized lean-to-steer device comprising:

a body for supporting a user;

a first wheel rotatable about a first wheel axis;

a first wheel mounting structure that attaches said first wheel to said body while allowing said body to tilt relative to said first wheel about a longitudinal axis while said first wheel axis remains horizontal, said first wheel mounting structure being configured to allow said first wheel to pivot about a vertical steering axis to alter the inclination of the first wheel axis relative to a vertical plane containing the longitudinal axis;

a second wheel mounted with respect to said body so as to rotate about a second wheel axis that is displaced from said first wheel axis along the longitudinal axis; said second wheel being configured and mounted so as to allow said body to tilt about the longitudinal axis;

a tilt sensor for monitoring the degree of tilt of said body relative to said first wheel about the longitudinal axis;

a speed sensor that provides a signal indicating the current speed of the device across the underlying surface;

a steering motor for adjusting the angular position of said first wheel about the steering axis; and a controller that receives a tilt signal from said tilt sensor and controls said steering motor to adjust the angular position of said first wheel about the steering axis in response to both the tilt signal and the speed signal.

7. The lean-to-steer device of claim 6 wherein said controller acting to provide a first response function adjusting the angular position of said first wheel responsive to the tilt signal when the degree of tilt indicated by the tilt signal is within a first tilt range, and acting to provide a second response function adjusting the angular position of said first wheel responsive to the tilt signal when the degree of tilt indicated by the tilt signal is within a second tilt range, wherein said second response function is different from said first response function.

8. The lean-to-steer device of claim 6 further comprising:

a drive motor operably coupled to drive one of said first wheel and said second wheel.

9. The lean-to-steer device of claim 7 further comprising:

an operator interface that allows an operator to select the parameters of the first tilt range and the second tilt range.

10. The lean-to-steer device of claim 1 wherein said first response function provides a proportional increase in angle of said first wheel from a center position in response to increasing increase in angle of tilt of said body from a central position.

11. The lean-to-steer device of claim 7 further comprising:

a tilt set point routine for said controller, said tilt set point routine operating to establish the first tilt range and the second tilt range, responsive to the speed signal.

* * * * *